US006679721B2

(12) United States Patent
Kim

(10) Patent No.: US 6,679,721 B2
(45) Date of Patent: Jan. 20, 2004

(54) MODULE INSERTION TOOL

(75) Inventor: Dong-Hyon Kim, Sunnyvale, CA (US)

(73) Assignee: Sun Microsystems, Inc., Palo Alto, CA (US)

( * ) Notice: Subject to any disclaimer, the term of this patent is extended or adjusted under 35 U.S.C. 154(b) by 197 days.

(21) Appl. No.: 09/924,223

(22) Filed: Aug. 6, 2001

(65) Prior Publication Data

US 2003/0026062 A1 Feb. 6, 2003

(51) Int. Cl.[7] ..... H01R 13/627
(52) U.S. Cl. ..... 439/362; 81/57.22
(58) Field of Search ..... 439/362, 364; 29/837; 81/57.22

(56) References Cited

U.S. PATENT DOCUMENTS 4,935,847 A * 6/1990 Welsh ..... 439/374
5,169,334 A * 12/1992 Makita ..... 439/362
5,218,758 A * 6/1993 Nguyen ..... 29/837
5,251,706 A * 10/1993 Evans ..... 173/29
5,966,289 A * 10/1999 Hastings et al. ..... 439/362

* cited by examiner

*Primary Examiner*—Neil Abrams
(74) *Attorney, Agent, or Firm*—O'Melveny & Myers LLP

(57) ABSTRACT

The present invention is a module insertion tool for anchoring a module to a motherboard. The module insertion tool has two drivers on either side of the tool that operate independently of each other, and help in anchoring the module to the motherboard. There is a knob built into the tool. The knob is connected to a chain that turns the drivers until a preset torque value is reached. The two drivers built into the tool are independent of each other and each driver turns until the preset torque value has been reached. This preset torque value can be obtained by either manually turning the knob, or by attaching an electric source to a socket built into the knob. There are three locators on a bottom plate of the tool that help in the alignment of the module to the tool, and there are locking pins on each driver that hold the module stationary while the module is being anchored to the motherboard by the drivers of the tool.

20 Claims, 8 Drawing Sheets

MODULE INSERTION TOOL

BACKGROUND OF THE INVENTION

1. Field of the Invention

The present invention relates primarily to the field of hardware, and in particular to a module insertion tool.

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all rights whatsoever.

2. Background Art

A module has several hardware components connected together in order to create a computer system. Some of the hardware components that need to be connected on a module include a central processing unit (CPU), a static random access memory (SRAM or RAM), and a casing that will connect the module to a motherboard. Usually, most of the hardware components are easy to attach or group together on a module without restriction to their layout. But the module has to be precisely aligned onto the motherboard in order for the computer system to work correctly, and achieving this precise alignment has its own specialized draw-backs which have yet to be overcome.

Incorrect alignment of the module may result in system failure, for example, due to burnt motherboards. An incorrect alignment of the module may result in grounding of a component pin which may cause short circuit in the motherboard when powered. Another outcome of incorrect alignment may result in bent component pins. Yet another outcome may result in cracked fabricators. An incorrect alignment may result in an uneven weight distribution of the module on the motherboard, which may result in cracking of the fabricator.

This loss of material may be extremely costly, especially for a fabrication plant that produces these computer systems in large volumes. If the incorrect alignment of the module does not result in burnt motherboards, bent component pins, or cracked fabricators, to name a few, then there is a loss of man-hours spent in fixing the incorrect alignment of the module since these modules are mounted onto the motherboards with human input. Some of the commercially available desktop modules include the 600/750/900 MHz UltraSPARC-III™ CPU modules made by Sun Microsystems, Inc., where the speed of the CPU is used to categorize the desktop module. One such desktop module, and the present system fabrication problems using this desktop module as an example are discussed in further detail below.

Desktop Module

A desktop module is illustrated in FIG. 1. The desktop module has two drivers 100 shrouded on either side of the module, that are used to anchor the module to a motherboard. These drivers are housed in connectors 110 also called captive screws. A surface mount matched impedance connector, or MICTOR, is one such connector used to anchor the module to a motherboard. The present design of the desktop module, and the attached drivers in the connectors require a precise quarter turn to each of the pre-set torque drivers in succession to ensure the module is inserted on the motherboard as parallel as possible.

The requirement of having the desktop module precisely parallel to the motherboard is critical in ensuring that each pin of every component on the module has mated correctly with its counterpart on the motherboard. Since the requirement of having the desktop module precisely parallel is performed by a human operator, it can be a time consuming task to accomplish, especially since many desktop module are bulky and heavy. Even if the desktop module is mounted on the motherboard with utmost care, it may still result in a low accuracy of the installation because currently there are no mechanical tools to help in aligning the module perfectly parallel to the motherboard. Parallelism is eyeballed by a human operator.

Furthermore, since the task of aligning the desktop module parallel to the motherboard is done manually, there can be a faulty installation of the desktop module resulting in bent component pins, cracked fabricators, burnt modules, connectors, and motherboards. Moreover, there may be several different groups of human operators that mount one or more desktop modules on a motherboard (some system designs warrant multiple modules per motherboard), or group other components together at the system level. There may be some individuals in the group that do not follow the stringent requirement of alternately turning each of the drivers in the connectors by a precise quarter turn, or there may be other time constraints like deadlines that result in faulty and incorrect mounting of the desktop module onto the motherboard. These are some of the reasons that eventually result in an unrecoverable loss of both man-hours and material.

SUMMARY OF THE INVENTION

The present invention is a module insertion tool. According to one embodiment of the present invention, the module is a desktop module. According to another embodiment of the present invention, there are two drivers on either side of the module insertion tool that operate independently of each other. According to another embodiment of the present invention, these drivers are used to anchor the module to a motherboard. According to another embodiment of the present invention, each driver has a slip coupling disk connected by a chain that ends in a plastic knob. By rotating the plastic knob, both the drivers independently turn in the direction of the rotation.

According to another embodiment of the present invention, there is a preset torque on the drivers, which are user dependent. In other words, the torque value has to be inputted manually, but can be changed for different situations and designs of the module and motherboard. According to another embodiment of the present invention, the drivers will turn until the preset torque value on the drivers is met. Since the drivers are independent of each other, each driver will stop turning when the preset torque value on its end is reached.

According to another embodiment of the present invention, there are three locators on a bottom plate of the module insertion tool that help in the alignment of the module. According to another embodiment of the present invention, there is a locking pin on each of the two drivers that help in securing the module to the motherboard. According to another embodiment of the present invention, a gear holder helps in controlling the tension in the chain. According to another embodiment of the present invention, a socket attached to the knob allows a user to connect an electrically powered driver. This driver aids in accelerating the process time needed to mount the module onto the motherboard.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The invention is a module insertion tool. In the following description, numerous specific details are set forth to provide a more thorough description of embodiments of the invention. It will be apparent, however, to one skilled in the art, that the invention may be practiced without these specific details. In other instances, well known features have not been described in detail so as not to obscure the invention.

Desktop Module

According to one embodiment of the present invention, the module is a desktop module. The UltraSPARC-III™ CPU desktop module is one example of a desktop module that will be used to disclose the design and usefulness of the present invention. But the present invention can be used on other modules, and is not restricted to the UltraSPARC-III™ CPU desktop module. Furthermore, the illustrations of the module insertion tool have dimensions in inches, and specifications of materials made out of steel, aluminum, etc., which are for illustration purposes only. The scope of the present invention is not restricted to the dimensions or to the material specifications mentioned in the illustrations, and can be implemented using other dimensions and materials which will be dictated by the design and shape of the module and motherboard.

Module Insertion Tool

Figure 1:
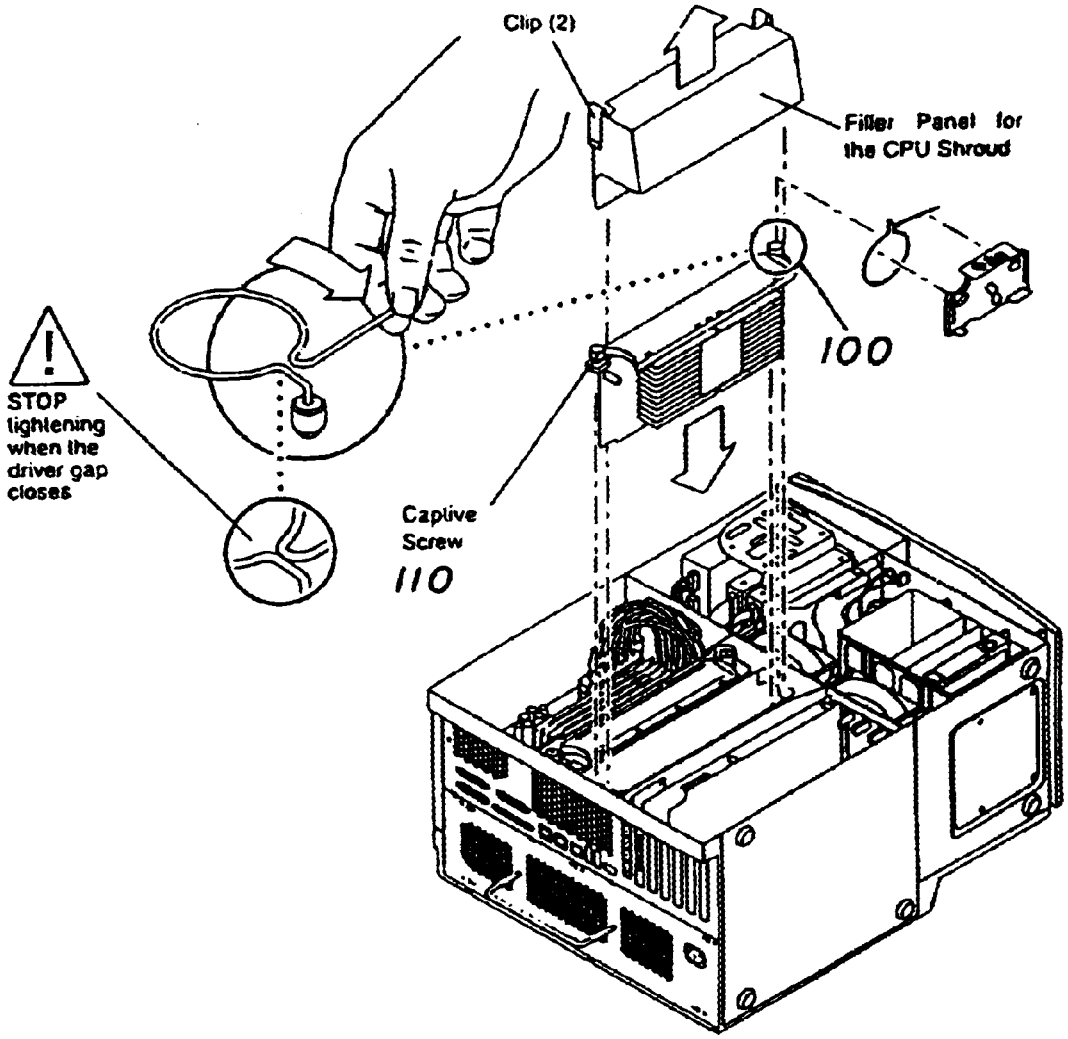
FIG. 1 PRIOR ART
FIG. 1 is an illustration of a prior art module.
Figure 2:
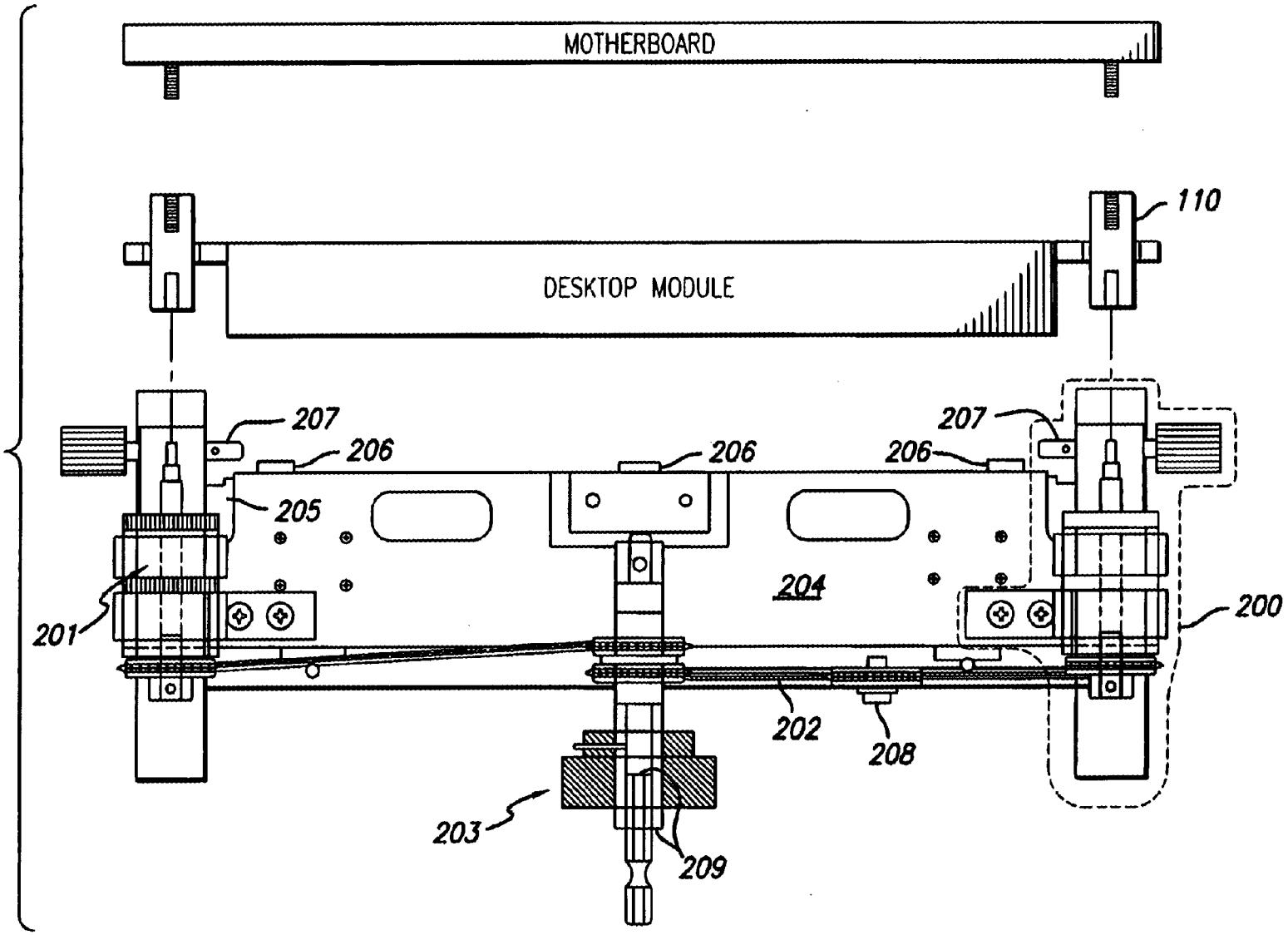
FIG. 2 is a cross-sectional view of the present invention with a desktop module and motherboard.

A cross-sectional view of the present invention is illustrated in FIG. 2, where 200 are two drivers on either side of the module insertion tool. Each driver has a slip coupling disk 201 connected by a chain 202 that ends in a knob 203. Knob 203 may be made out of plastic or similar material. There are two plates in the module insertion tool, where 204 is the top plate and 205 is the bottom plate. 206 indicates 3 locators on the bottom plate, and 207 indicates locking pins on both sides of the module insertion tool. 208 indicates a gear holder that helps in controlling the tension in chain 202. Socket 209, which allows a user to electrically power the driver, is built into knob 203. Each of these parts along with their functionality and usage are explained in further detail below.

Figure 3:
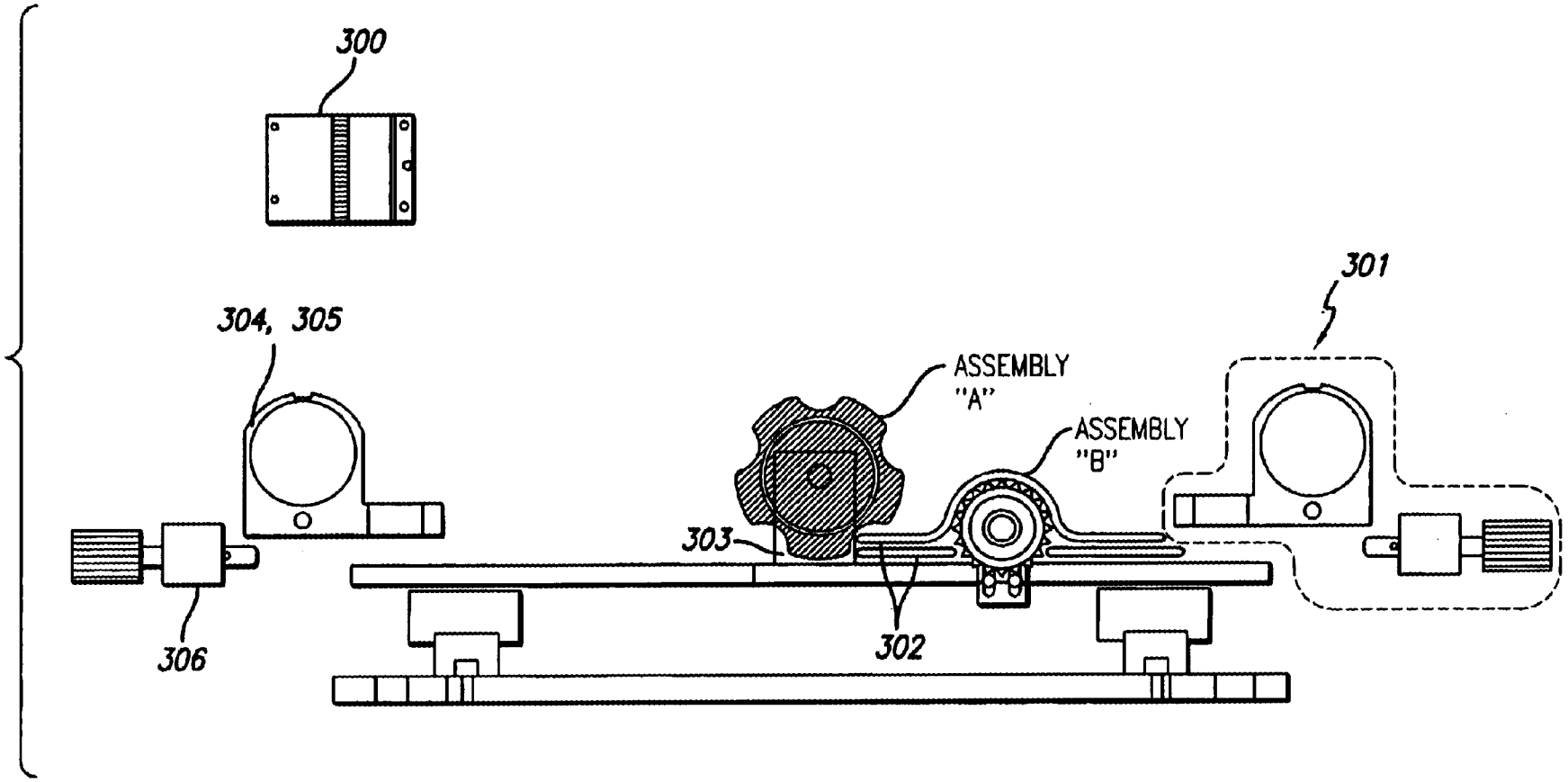
FIG. 3 illustrates one or more embodiments of the present invention.

FIG. 3 illustrates one or more embodiments of the present invention. The figure shows a detailed illustration of the two drivers, slip coupling disk, knob, chain, and locking pins. Slip coupling disk 300 ensures that drivers 301 do not slip when chain 302 is tightened or loosened by rotating knob 303. The slip coupling is encased in coupling holders 304 and 305. Locking pins 306, which can be rotated clockwise to lock the insertion tool in a desired position, and anti-clockwise to unlock the module insertion tool, help in keeping the drivers stationary during the entire operation of mounting the module to a motherboard.

The drivers have a preset torque, which is inputted by a user depending upon the design requirements of the module and motherboard. In operation, once the module is placed in position, the locking pins are tightened to ensure that the module remains stationary during the entire operation. Next, the knob is turned either clockwise or anti-clockwise. This moves the chain, which increases or decreases the torque in the drivers. Since the drivers are independent of each other, each driver turns until the preset torque on its side is met. In other words, one driver may reach its preset torque value sooner than the other, but each driver will stop independent of the other once its preset torque value has been reached. This ensures that even if the module was not perfectly parallel to the motherboard at the beginning of the operation, it will be once both the drivers stop turning.

Figure 4:
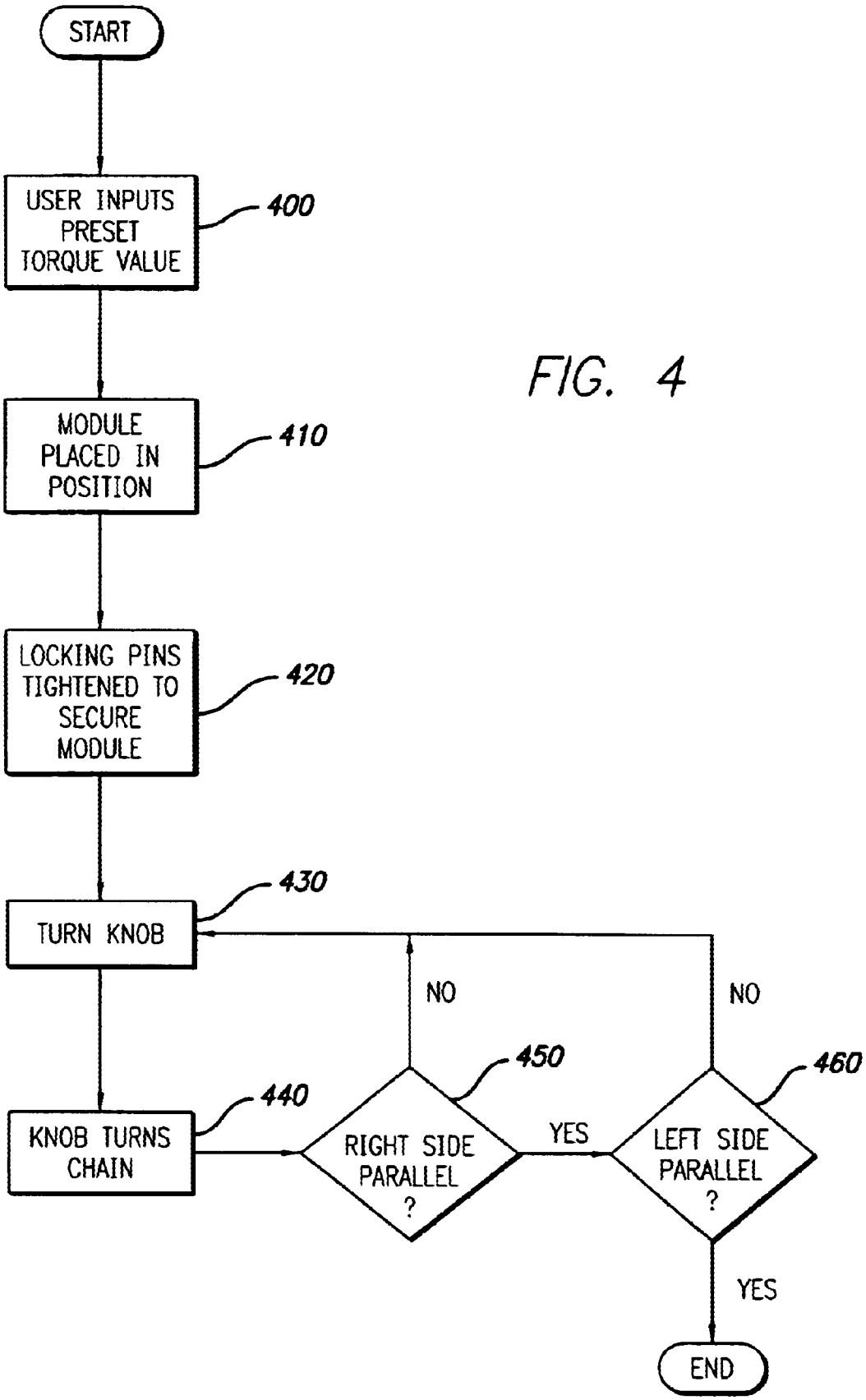
FIG. 4 illustrates a flow diagram showing exemplary steps of a method according to one or more embodiments of the present invention.

FIG. 4 illustrates the operation of manually attaching a module parallel to a motherboard. At box 400, a user inputs a preset torque value. At box 410, a module is placed in position over a motherboard. At box 420, locking pins on the module are tightened to secure the module from moving. At box 430, a knob on the module is turned. This knob turns a chain, which is seen at box 440. At box 450, a check is made to see if the right side of the module has reached the preset torque value. If it has not, then boxes 430 and 440 are repeated until the preset torque value on the right side of the module is reached. Once the right side is level, at box 460 a check is made to see if the left side of the module has reached the preset torque value. If it has not, then boxes 430 through 450 are repeated until the preset torque value on the left side of the module is reached. It must be noted here that boxes 450 and 460 can be interchanged. In other words, the left side can be checked for parallelism before the right side.

Figure 5:
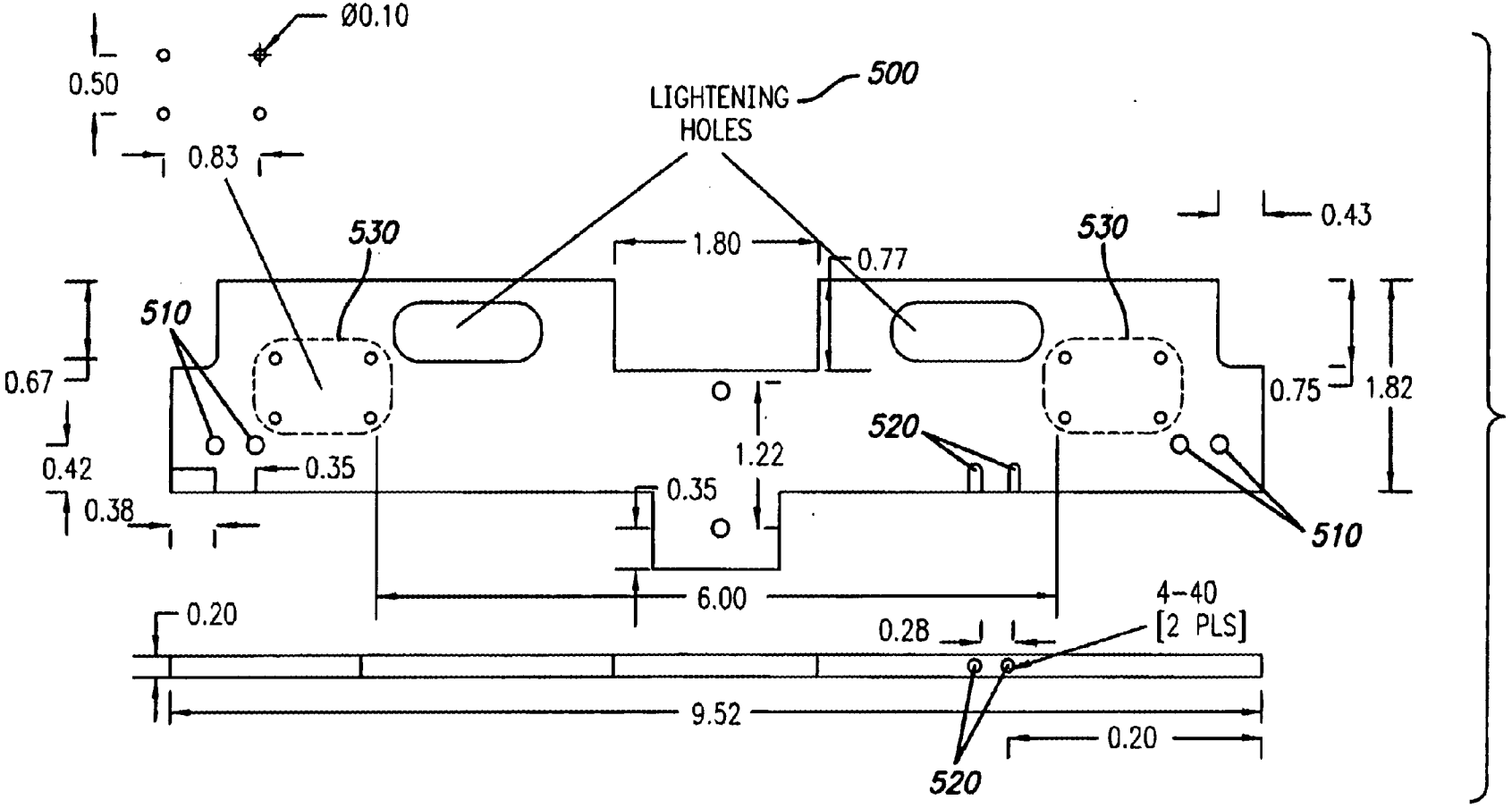
FIG. 5 illustrates one or more embodiments of the present invention.
Figure 6:
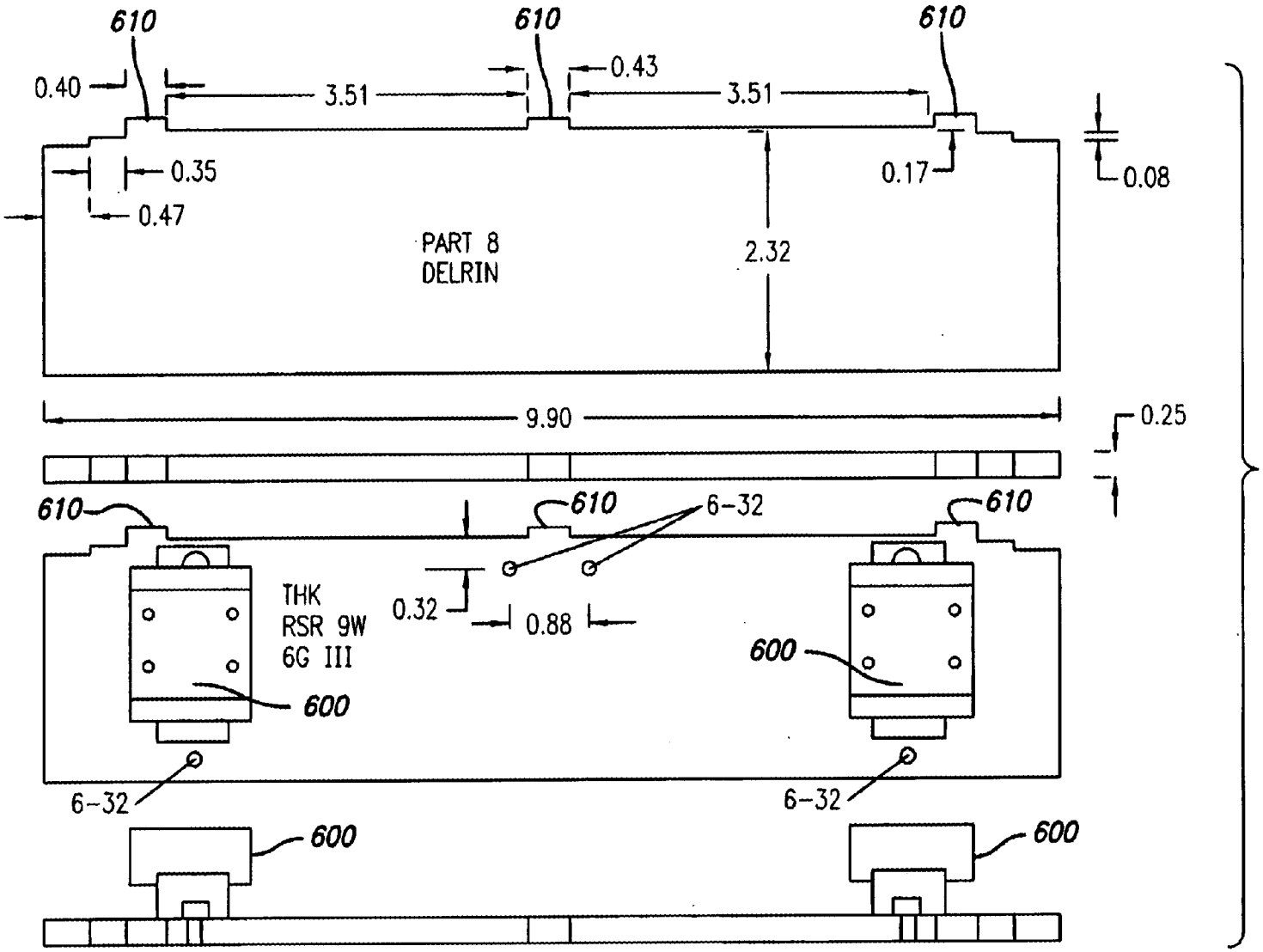
FIG. 6 illustrates one or more embodiments of the present invention.
Figure 7:
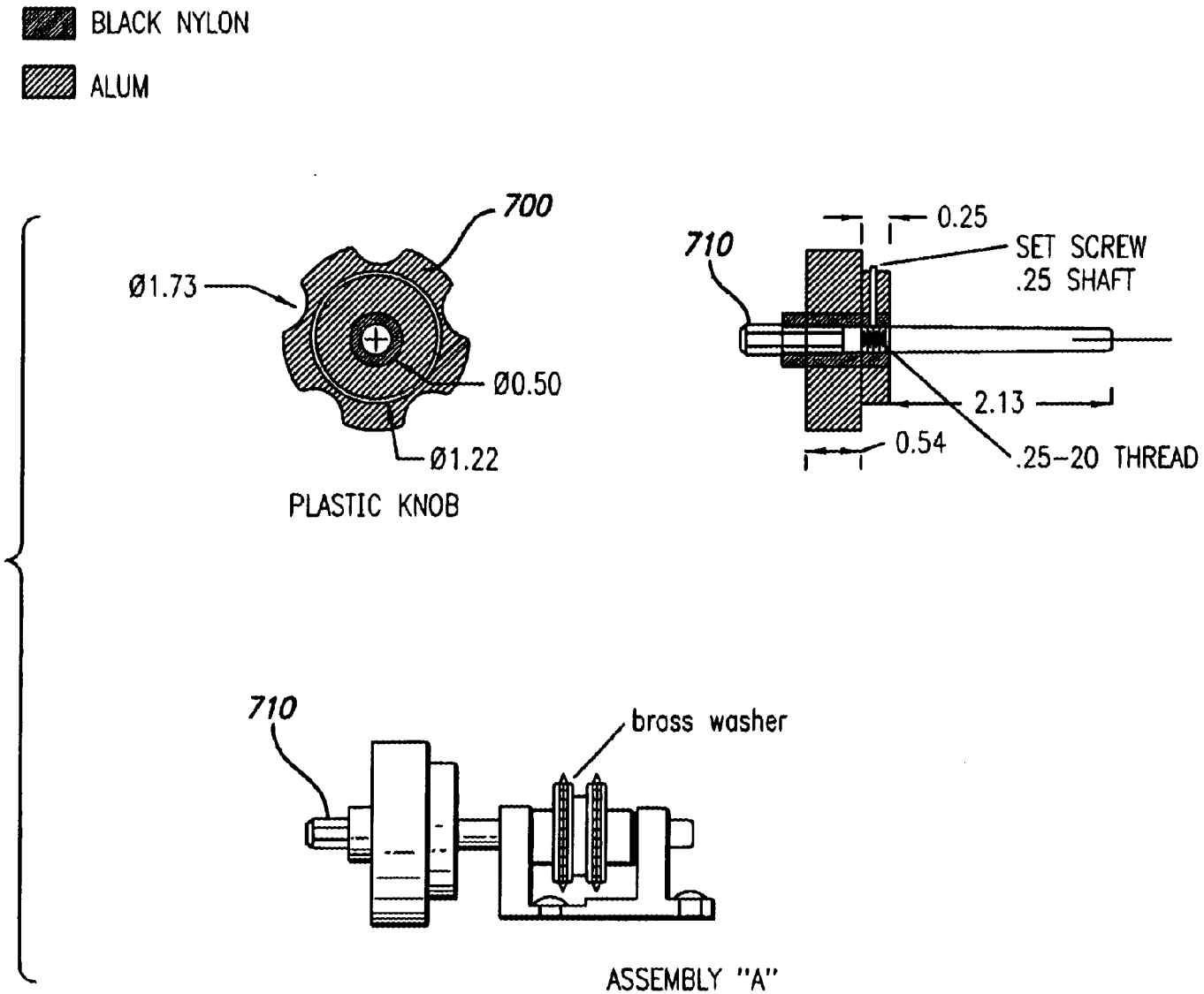
FIG. 7 illustrates one or more embodiments of the present invention.
Figure 8:
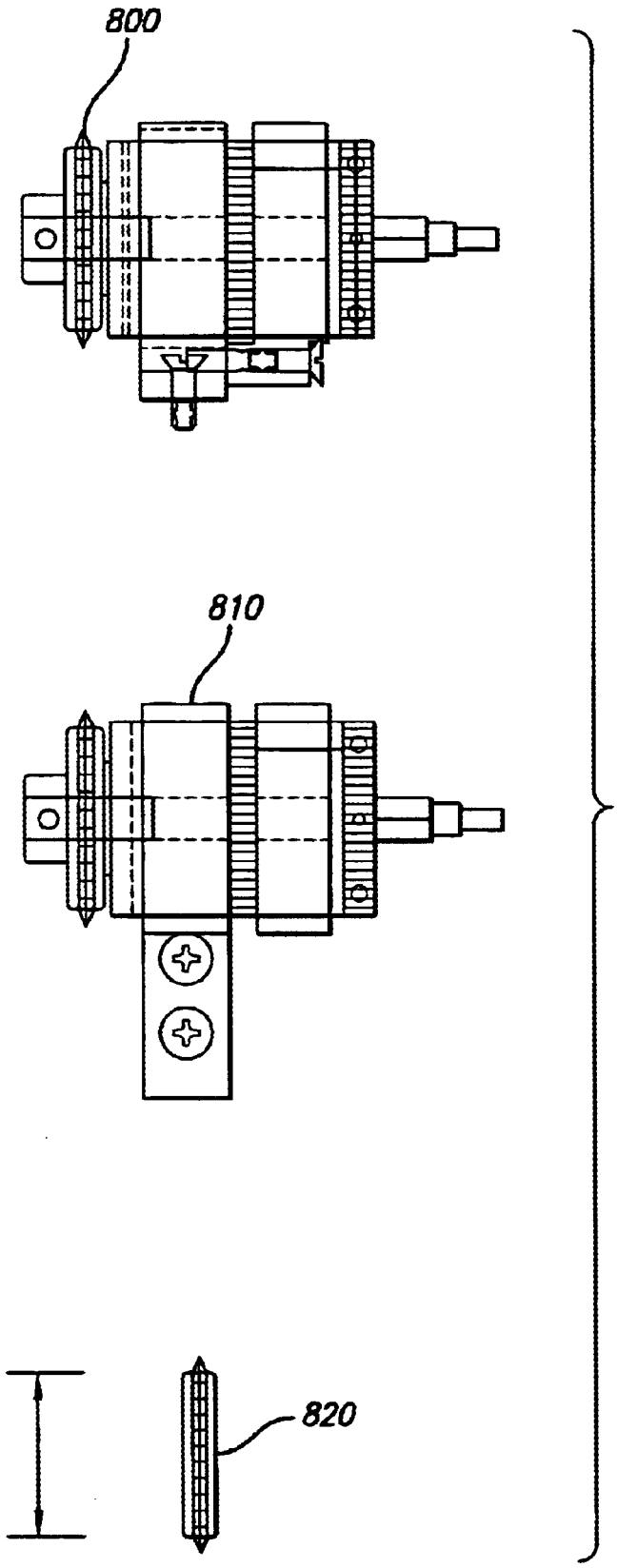
FIG. 8 illustrates one or more embodiments of the present invention.

Top plate 204 is explained in detail in FIG. 5, bottom plate 205 is explained in detail in FIG. 6, knob assembly "A" is explained in detail in FIG. 7, and gear holder assembly "B" is explained in detail in FIG. 8.

Top Plate

FIG. 5 illustrates one or more embodiments of the present invention. The figure shows a side and top view of the top plate. It has two openings (500) called lightening holes, which are made to reduce the overall weight of the module, and two holes (510) on either side where the driver assemblies get attached. It also has a couple of holes (520) where the gear holder parts get attached. The top and bottom plates are held in place with the help of two rectangular pieces, and the top plate has a set of 4 screw holes (530) on either side where these rectangular pieces get attached.

Bottom Plate

FIG. 6 illustrates one or more embodiments of the present invention. The figure shows one side view, and two top views of the bottom plate. One of the top view illustration also shows the two rectangular pieces 600 that hold the top and bottom plates in place. 610 indicates three locators on the bottom plate that help in aligning the indentations on the module with the motherboard.

Knob Assembly "A"

FIG. 7 illustrates one or more embodiments of the present invention. One view shows an illustration of plastic knob 700 along with its dimensions. Another is a side view of standard socket 710, which is built directly into the knob. This socket is used to connect an electrical source if the chain's torque is adjusted by non-manual means. The last illustration is a detailed view of socket 710 built into knob 700.

Gear Holder Assembly "B"

FIG. 8 illustrates one or more embodiments of the present invention. The figure shows two top views (800 and 810) of the gear holder assembly. This assembly is attached to the bottom plate and has a toothed wheel 820 around which a chain is wrapped. The other two side view figures are of parts that hold the toothed wheel 820 in place. This toothed wheel pushes up on the chain, and this controls the tension in the chain while the torque value is being manipulated by turning the knob.

Thus, a module insertion tool is described in conjunction with one or more specific embodiments. The invention is defined by the following claims and their full scope of equivalents.

I claim:

1. A module insertion tool for anchoring a module to a motherboard comprising:

a plurality of drivers for anchoring the module to the motherboard;

a plurality of locators connected with said plurality of drivers, said plurality of locators aligning the module to said modular insertion tool; and a knob connected with said plurality of drivers, said knob having a socket;

wherein said plurality of locators further aligns the module to the motherboard as the module is being anchored by said plurality of drivers to the motherboard;

wherein said knob rotates said plurality of drivers as said plurality of drivers are used to anchor the module to the motherboard; and wherein each of said drivers are rotated by said knob independent of each other.

2. The module insertion tool of claim 1, wherein said module insertion tool comprises a desktop module insertion tool.

3. The module insertion tool of claim 1, wherein said socket is adapted to connect with an electric source for turning said knob.

4. The module insertion tool of claim 1, wherein one of said plurality of drivers is rotatable by operation of said knob while another one of said plurality of drivers idles.

5. The module insertion tool of claim 4, wherein each of said plurality of drivers comprises a slip coupling disk.

6. The module insertion tool of claim 5, further comprising a chain and wherein said knob is connected with said slip coupling disk of each of said plurality of drivers via said chain.

7. The module insertion tool of claim 6, wherein said knob turns said chain and wherein said chain independently rotates each of said plurality of drivers via said slip coupling disk of each of said plurality of drivers.

8. The module insertion tool of claim 7, further comprising a gear holder connected with said chain, wherein said chain turns around said gear holder and wherein said gear holder controls a tension in said chain.

9. The module insertion tool of claim 7, further comprising a gear holder connected with said chain, wherein said chain turns around said gear holder and wherein said gear holder controls a preset torque in one of said plurality of drivers.

10. The module insertion tool of claim 1, wherein each of said plurality of drivers has a preset torque.

11. The module insertion tool of claim 10, wherein each said preset torque of said plurality of drivers is independently set.

12. The module insertion tool of claim 10, wherein each said preset torque of said plurality of drivers is user dependent.

13. The module insertion tool of claim 12, wherein each of said plurality of drivers rotates independently of each other until said preset torque on each of said plurality of drivers is met.

14. The module insertion tool of claim 1, further comprising a plurality of locking pins respectively connected to each of said plurality of drivers, wherein said plurality of locking pins secure the module to said module insertion tool after the module has been aligned by said plurality of locators of said module insertion tool.

15. The module insertion tool of claim 1, further comprising a plurality of locking pins respectively connected to each of said plurality of drivers, wherein said plurality of locking pins allow a user to anchor the module to the motherboard via said plurality of drivers without touching the module.

16. A method of using a module insertion tool for anchoring a module to a motherboard, said method comprising:

inputting a preset torque value for each of a plurality of drivers built into said module insertion tool;

placing the module in an aligned position on said module insertion tool via at least one locator built into said module insertion tool;

locking the module with at least one locking pin to secure the module to said module insertion tool; and turning a single knob built into said module insertion tool to rotate each of said plurality of drivers in order to anchor the module to the motherboard after the module has been inserted into the motherboard.

17. The method of claim 16, wherein said turning said knob further comprises turning a chain connected to said knob and each of said plurality of drivers.

18. The method of claim 17, further comprising:

measuring a torque value on a first driver of said plurality of drivers located on a right side of the module to see if said preset torque value on said first drivers has been reached; and measuring a torque value on a second driver of said plurality of drivers located on a left side of the module to see if said preset torque value on said second driver has been reached.

19. The method of claim 18, wherein said turning said knob is repeated until said present torque values on each of said first and said second drivers has been reached.

20. The method of claim 16, wherein said turning said knob further comprises independently rotating each of said plurality of drivers until said preset torque value for each of said plurality of drivers has been met and independently idling each of said plurality of drivers once said present torque value for each of said plurality of drivers has been met.

* * * * *